US006357508B1

(12) United States Patent
Tronsgard et al.

(10) Patent No.: US 6,357,508 B1
(45) Date of Patent: Mar. 19, 2002

(54) DOUBLE TILT MECHANISM FOR VENETIAN BLINDS

(75) Inventors: Ken Tronsgard; Jocelyn Tronsgard, both of North Battleford; James W. Strutt, Ottawa, all of (CA)

(73) Assignee: Suntier Inventions Ltd., North Battleford (CA)

( * ) Notice: Subject to any disclaimer, the term of this patent is extended or adjusted under 35 U.S.C. 154(b) by 0 days.

(21) Appl. No.: 09/775,008

(22) Filed: Feb. 1, 2001

(51) Int. Cl.[7] ..... E06B 9/26
(52) U.S. Cl. ..... 160/115; 160/177 R
(58) Field of Search ..... 160/115, 177 R, 160/177 V, 176.1 R, 176.1 V, 168.1 R

(56) References Cited

U.S. PATENT DOCUMENTS 4,621,672 A 11/1986 Hsu
4,869,308 A 9/1989 Chang
5,119,868 A 6/1992 Werner
5,845,691 A 12/1998 Gaines
6,076,587 A 6/2000 Pastor
6,176,290 B1 * 1/2001 Hsu ..... 160/115 X

* cited by examiner

*Primary Examiner*—David M. Purol
(74) *Attorney, Agent, or Firm*—Jeffrey A Haeberlin; Middleton Reutlinger

(57) ABSTRACT

An apparatus for tilting upper and lower tiers of slats in a venetian blind independently comprises a headrail attached to a top end of the venetian blind. A first shaft is rotatably mounted in the headrail and is operative to tilt the upper tier of slats when rotated. A second shaft is rotatably mounted in the headrail substantially parallel to the first shaft to tilt the lower tier of slats. A driving member is pivotally mounted in the headrail and is movable from a first position engaging the first shaft and disengaged from the second shaft, to a second position engaging the second shaft and disengaged from the first shaft. Rotation of the driving member causes rotation of the engaged shaft. A control rod rotates the driving member, and moves the driving member from the first position to the second position.

11 Claims, 2 Drawing Sheets

DOUBLE TILT MECHANISM FOR VENETIAN BLINDS

This invention is in the field of Venetian blind window coverings and in particular such blinds with two separate tiers of slats.

BACKGROUND

It is well known to provide a venetian blind with separate upper and lower tiers of slats which can be tilted independently of each other. These two-tier blinds require a mechanism for tilting the tiers independently. Examples of such mechanisms are disclosed in U.S. Pat. No. 4,621,672 to Hsu, U.S. Pat. No. 4,869,308 to Chang, U.S. Pat. No. 5,119,868 to Werner, U.S. Pat. No. 5,845,691 to Gaines, and U.S. Pat. No. 6,076,587 to Pastor.

The Hsu mechanism uses two worm wheels driven by first and second worms. The worms have a splined inner aperture. A gear is mounted on a shaft. The shaft is moved along its axis so that the gear moves from engaging the first worm to tilt a first tier, to engaging the second worm to tilt a second tier of slats.

The Chang mechanism uses a gear fixed to each of the two tilting shafts, and an outer sleeve with an inner splined portion that is moved so that the splined portion engages and drives one or the other of the gears.

The Werner mechanism utilizes a pair of outer sleeves at each side of the blind, one of each pair tilting the upper tier, and the other of the pair tilting the lower tier. Two gears are fixed to a shaft which slides so that the gears engage one or the other sleeve at each end, or both in order to operate the tiers together.

The Gaines mechanism uses two separate control rods, one to tilt the upper tier and one to tilt the lower tier.

The Pastor mechanism employs a reversing mechanism with plates meshing and un-meshing in response to a bias force. The tiers tilt together until over-rotation causes the plates to un-mesh, and one tier then moves in the opposite direction.

While the above mechanisms are suitable for the purpose, an improved economical and simple mechanism requiring only one control rod, which could be easily moved intuitively to the proper position for adjusting the desired tier of slats, would be beneficial.

SUMMARY OF THE INVENTION

It is the object of the present invention to provide a simple and economical apparatus for tilting upper and lower tiers of slats in a venetian blind independently.

It is a further object of the present invention to provide such an apparatus that utilizes a single driving member to drive one or the other of a pair of shafts, each shaft controlling one of the upper and lower tiers of slats, wherein the driving member moves pivotally from engagement with one shaft to engagement with the other shaft.

In a first aspect the invention provides an apparatus for tilting upper and lower tiers of slats in a venetian blind independently. The apparatus comprises a headrail attached to a top end of the venetian blind. A first shaft is rotatably mounted in the headrail and is operatively connected to the upper tier of slats and is operative to tilt the upper tier of slats when rotated. A second shaft is rotatably mounted in the headrail substantially parallel to the first shaft. The second shaft is operatively connected to the lower tier of slats and is operative to tilt the lower tier of slats when rotated. A first worm wheel is attached to the first shaft such that a shaft axis and wheel axis thereof coincide, the first worm wheel rotating with the first shaft. A second worm wheel is attached to the second shaft such that a shaft axis and wheel axis thereof coincide, the second worm wheel rotating with the second shaft. The second worm wheel is located on the second shaft at a horizontal location substantially vertically aligned with the first worm wheel. A worm is pivotally mounted in the headrail about a substantially horizontal axis, the worm movable about the horizontal axis from a first position engaging the first worm wheel and disengaged from the second worm wheel, to a second position engaging the second worm wheel and disengaged from the first worm wheel. The worm is rotatable about a worm axis such that rotation of the worm causes rotation of the engaged worm wheel and the respective shaft. A control rod is operatively connected to the worm to rotate the worm, and is further operative to move the worm from the first position to the second position.

In a second aspect the invention provides an apparatus for tilting upper and lower tiers of slats in a venetian blind independently. The apparatus comprises a headrail attached to a top end of the venetian blind. A first shaft is rotatably mounted in the headrail and is operatively connected to the upper tier of slats and is operative to tilt the upper tier of slats when rotated. A second shaft is rotatably mounted in the headrail substantially parallel to the first shaft. The second shaft is operatively connected to the lower tier of slats and is operative to tilt the lower tier of slats when rotated. A driving member is pivotally mounted in the headrail and is movable from a first position engaging the first shaft and disengaged from the second shaft, to a second position engaging the second shaft and disengaged from the first shaft. The driving member is rotatable about an axis hereof such that rotation of the driving member causes rotation of the engaged shaft. A control rod is operatively connected to the driving member to rotate the driving member, and is further operative to move the driving member from the first position to the second position.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
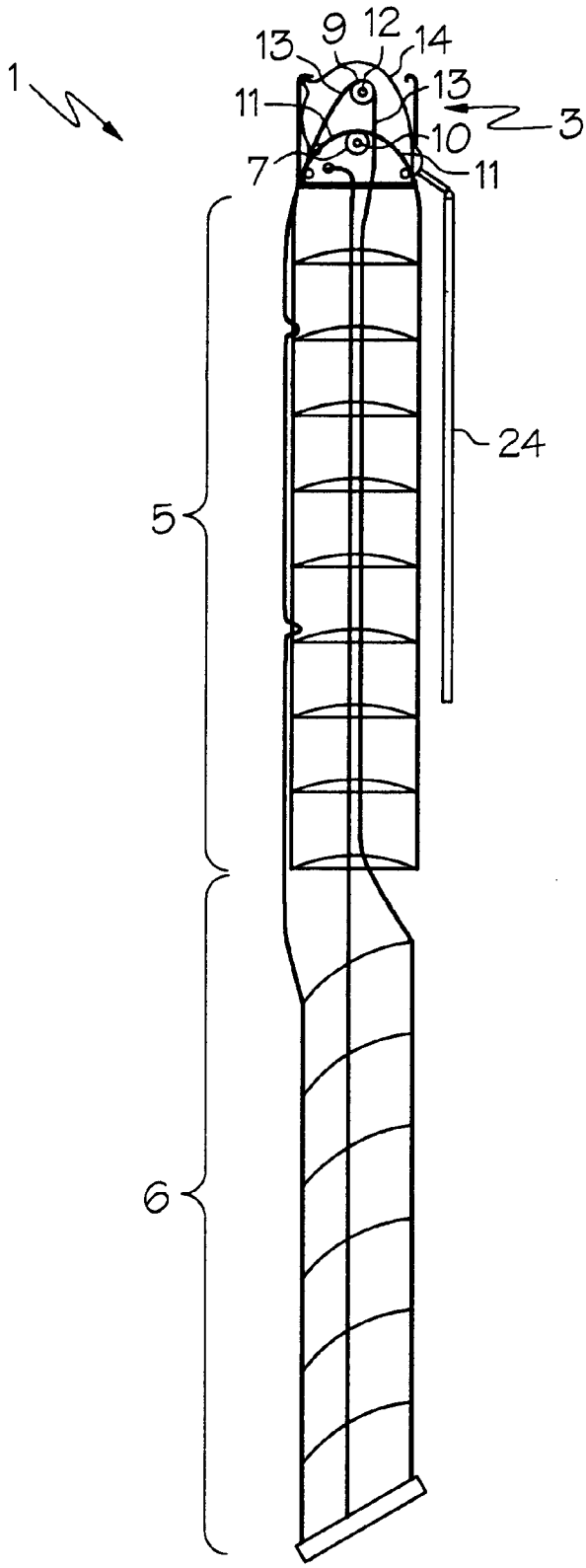
FIG. 1 is a schematic cross-sectional side view of a typical two-tier venetian blind with the an apparatus of the invention installed in the support headrail of the blind.

FIG. 1 illustrates a typical two-tier venetian blind 1 incorporating an apparatus 3 for tilting the upper and lower tiers of slats 5, 6 independently. The apparatus 3 comprises a headrail 8 attached to a top end of the venetian blind 1. A first shaft 10 is rotatably mounted in the headrail 8 and is operatively connected to the upper tier of slats 5 via first roller 7 and first cords 11 and is operative to tilt the upper tier of slats 5 when rotated. A second shaft 12 is rotatably mounted in the headrail 8 substantially parallel to the first shaft 10. The second shaft 12 is operatively connected to the lower tier of slats 6 via second roller 9 and second cords 13 and is operative to tilt the lower tier of slats 6 when rotated. The cords 11, 13 may be configured in various ways to connect the shafts 10, 12 to the slats 5, 6. The illustrated cord configuration is an example only of the possible configurations.

Figure 3:
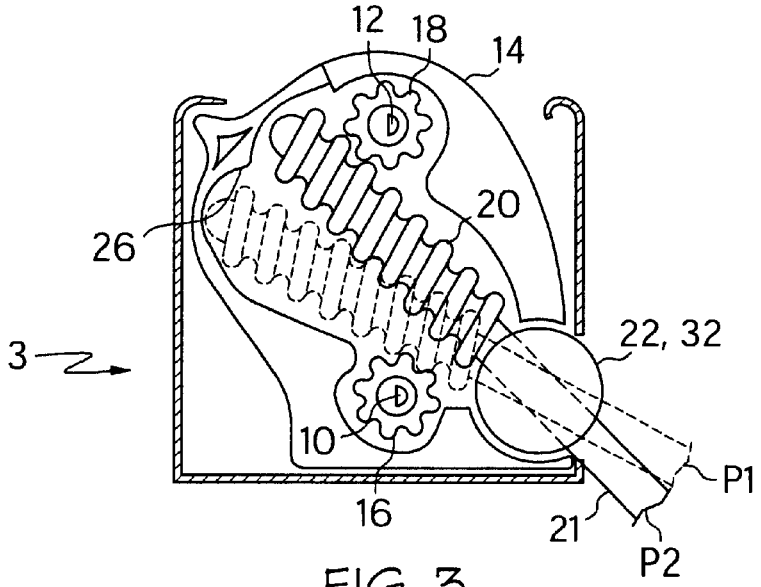
FIG. 3 and FIG. 4 is a schematic cross-sectional side view of the worm housing.

FIG. 3 illustrates the worm housing 14 installed in the headrail 8. As illustrated in FIG. 3, a first worm wheel 16 is attached to the first shaft 10 such that a shaft axis and wheel axis thereof coincide. A second worm wheel 18 is attached to the second shaft 12 such that a shaft axis and wheel axis thereof coincide. The shafts 10, 12 have an outer periphery that includes a flat side. The shafts 10, 12 slide through corresponding apertures in the worm wheels 16, 18 so that the worm wheels 16, 18 rotate with the shafts 10, 12. The shafts 10, 12 may thus be installed in the worm wheels 16, 18 after the worm housing 14 is installed in the headrail 8.

Any shape of shaft 10, 12 may be used that engages a corresponding aperture in the worm wheels. For example a rectangular or hexagonal shaft, or one with no flat side at all but with a curved shape, such as an oval, will cause the shaft to turn when the worm wheel is turned. The second worm wheel 18 is located at a horizontal location substantially vertically aligned with the first worm wheel 16.

Figure 2:
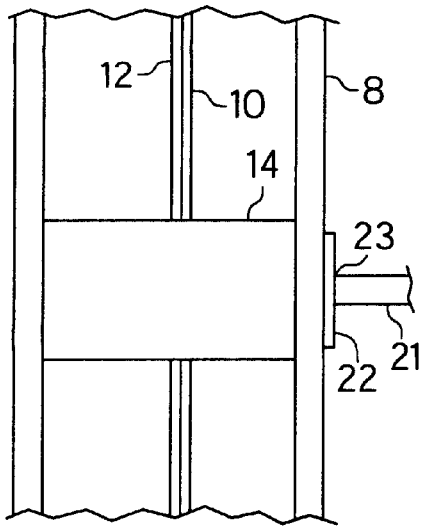
FIG. 2 is a top view of the worm housing mounted in the headrail.

The shafts 10, 12 are rotated by a driving member, worm 20, pivotally mounted in the headrail 8 about a substantially horizontal axis. As illustrated in FIGS. 2 and 3, a pivot shaft 22 is rotatably mounted in the worm housing 14 such that an axis thereof is substantially horizontal, and the worm 20 is attached to a worm shaft 21 that extends through an aperture 23 in the pivot shaft 22 and is rotatable in the aperture 23.

Figure 4:
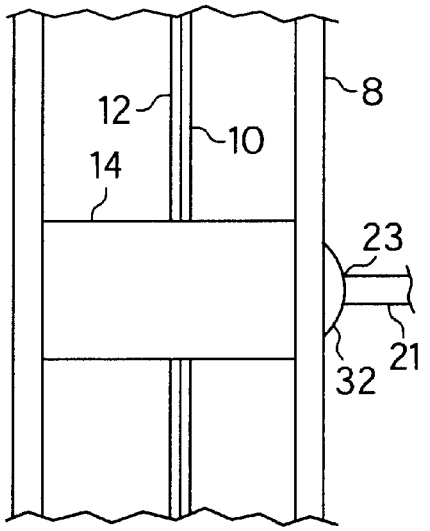

FIGS. 3 and 4 illustrate that a pivot ball 32 could be substituted for the pivot pin 22. The pivot axis of the pivot ball 32 would not necessarily be horizontal, but would still allow the proper motion of the worm 20.

The worm 20 is movable about the horizontal axis from a first position P1 engaging the first worm wheel and disengaged from the second worm wheel, as illustrated in phantom lines in FIG. 3, to a second position P2 engaging the second worm wheel and disengaged from the first worm wheel, as illustrated in FIG. 3.

A resilient protrusion 26 attached to the worm housing 14. The end of the worm 20 contacts the protrusion 26 and moves it out of the at rest position as the worm 20 moves from the first position P1 to the second position P2, and vice versa. The resilient protrusion 26 thus maintains the worm 20 in the first or second positions P1, P2. Alternatively an over-centering spring or the like could maintain the worm 20 in the desired position P1 or P2.

It is also contemplated that the worm 20 could be simply pushed into the proper position when it was desired to tilt the slats and held there while tilting. In FIG. 3, the resilient protrusion 26 could be eliminated. The orientation in FIG. 3 is such that in order to tilt the upper slats 5, the worm shaft 21 must be pushed up into the first position P1, and moved down into the second position P2 to tilt the lower slats 6. The movement is intuitive and natural. If the worm 20 was at rest in the second position P2, due to gravity, an operator could quite satisfactorily operate the blinds.

The worm 20 is rotatable about a worm axis such that rotation of the worm 20 causes rotation of the engaged worm wheel, 16 or 18, and the respective shaft, 10 or 12. The worm shaft 21 provides a control rod on the outside of the headrail 8 that is operatively connected to the worm 20 to rotate the worm 20, and to move the worm 20 from the first position P1 to the second position P2, and vice versa. A control extension 24 may be added as in conventional blind mechanisms.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. An apparatus for tilting upper and lower tiers of slats in a venetian blind independently, the apparatus comprising:

a headrail attached to a top end of the venetian blind;

a first shaft rotatably mounted in the headrail, the first shaft operatively connected to the upper tier of slats and operative to tilt the upper tier of slats when rotated;

a second shaft rotatably mounted in the headrail substantially parallel to the first shaft, the second shaft operatively connected to the lower tier of slats and operative to tilt the lower tier of slats when rotated;

a first worm wheel attached to the first shaft such that a shaft axis and wheel axis thereof coincide, the first worm wheel rotating with the first shaft;

a second worm wheel attached to the second shaft such that a shaft axis and wheel axis thereof coincide, the second worm wheel rotating with the second shaft, the second worm wheel located on the second shaft at a horizontal location substantially vertically aligned with the first worm wheel;

a worm pivotally mounted in the headrail about a substantially horizontal axis, the worm movable about the horizontal axis from a first position engaging the first worm wheel and disengaged from the second worm wheel, to a second position engaging the second worm wheel and disengaged from the first worm wheel, the worm rotatable about a worm axis such that rotation of the worm causes rotation of the engaged worm wheel and the respective shaft;

a control rod operatively connected to the worm to rotate the worm, and further operative to move the worm from the first position to the second position.

2. The apparatus of claim 1 further comprising a resilient member attached to the headrail, wherein the worm moves the resilient member out of an at rest position as the worm moves from the first position to the second position, and as the worm moves from the second position to the first position, such that the resilient member maintains the worm in the first or second positions.

3. The apparatus of claim 2 wherein the worm wheels, worm and resilient member are mounted in a worm housing and wherein the worm housing is attached to the headrail.

4. The apparatus of claim 3 wherein the first and second worm wheels are slidable along the respective shafts such that the shafts may be positioned in the headrail after the worm housing is mounted in the headrail.

5. The apparatus of claim 4 wherein the shafts have an outer periphery that engages corresponding holes in the worm wheels.

6. The apparatus of claim 5 wherein the shafts have an outer periphery that includes a flat side.

7. The apparatus of claim 1 further comprising a pivot shaft rotatably mounted in the headrail such that an axis thereof is substantially horizontal, and wherein the worm is attached to a worm shaft, and wherein the worm shaft extends through an aperture in the pivot shaft and is rotatable in the aperture.

8. The apparatus of claim 1 further comprising a pivot ball rotatably mounted in the headrail, and wherein the worm is attached to a worm shaft, and wherein the worm shaft extends through an aperture in the pivot ball and is rotatable in the aperture.

9. An apparatus for tilting upper and lower tiers of slats in a venetian blind independently, the apparatus comprising:

a headrail attached to a top end of the venetian blind;

a first shaft rotatably mounted in the headrail, the first shaft operatively connected to the upper tier of slats and operative to tilt the upper tier of slats when rotated;

a second shaft rotatably mounted in the headrail substantially parallel to the first shaft, the second shaft operatively connected to the lower tier of slats and operative to tilt the lower tier of slats when rotated;

a driving member pivotally mounted in the headrail and movable from a first position engaging the first shaft and disengaged from the second shaft, to a second position engaging the second shaft and disengaged from the first shaft, the driving member rotatable about an axis thereof such that rotation of the driving member causes rotation of the engaged shaft;

a control rod operatively connected to the driving member to rotate the driving member, and further operative to move the driving member from the first position to the second position.

10. The apparatus of claim 9 wherein the driving member is pivotally mounted in the headrail by extending the driving member through an aperture in a pivot ball, the pivot ball mounted in a corresponding socket defined by the headrail, and the driving member rotatable in the aperture.

11. The apparatus of claim 10 wherein the pivot ball is mounted in a housing, and wherein the housing is mounted in the headrail.

* * * * *